US007748088B1

(12) United States Patent
Johnston

(10) Patent No.: US 7,748,088 B1
(45) Date of Patent: Jul. 6, 2010

(54) BELT BUCKLE

(76) Inventor: Trevor Jamison Johnston, 1310 Alma Ave., #309, Walnut Creek, CA (US) 94596

( * ) Notice: Subject to any disclaimer, the term of this patent is extended or adjusted under 35 U.S.C. 154(b) by 59 days.

(21) Appl. No.: 12/004,277

(22) Filed: Dec. 19, 2007

(51) Int. Cl.
*A44B 11/00* (2006.01)

(52) U.S. Cl. ..... 24/163 K; 224/163

(58) Field of Classification Search ..... 24/163 K; 224/163; 40/640
See application file for complete search history.

(56) References Cited

U.S. PATENT DOCUMENTS 1,488,679 A * 4/1924 Jeannotte et al. ..... 206/39
3,927,442 A * 12/1975 Foster ..... 24/163 K
4,068,787 A * 1/1978 Craighead ..... 224/163
4,790,435 A * 12/1988 Trusty ..... 206/39.5

* cited by examiner

*Primary Examiner*—James R Brittain
(74) *Attorney, Agent, or Firm*—Risto A. Rinne, Jr.

(57) ABSTRACT

An apparatus for securing a pair of trousers about a torso includes a face plate and a flexible member that is attached along three perimeter sides of the flexible member to a rear surface of the face plate. A conventional type of a fastener assembly for a belt is attached to the flexible member. A first end of the belt is attached to a rear of the fastener assembly and a second end of the belt engages with a hook, the hook being attached to an opposite end of the fastener assembly. An opening between the face plate and the flexible member along a side of the flexible member that is not attached to the face plate is provided on the remaining side of the flexible member into which a credit card and a picture-identification card, such as a driver's license can be inserted or removed.

13 Claims, 2 Drawing Sheets

BELT BUCKLE

BACKGROUND OF THE INVENTION

1. Field of the Invention

The present invention, in general, relates to belt buckles and, more particularly, to a belt buckle that includes a compartment.

Belt buckles are well known devices used for fastening a belt, such as is used to retain trousers in position.

There has been a long-standing need to carry a valid picture identification, such as a driver's license, and credit card (or debit card, etc.) at most times when a person is away from home. The credit card is used for purchases and the picture identification is used to verify that the person is, as claimed, and also that the age of the person is above whatever minimum threshold is applicable.

There has also been a long-standing need not to lose the picture identification or the credit card. This need includes misplacement, for example, misplacement of a wallet as well as theft, including that by pickpockets.

A wallet creates a bulge in the pocket of trousers. The bulge is aesthetically unappealing. Worse yet, it provides a clear and easy signal to a pickpocket of its presence. Pickpockets (those who have skill in removing [i.e., stealing] items out of pockets) find that stealing a wallet out of a pocket is a fairly easy task to accomplish.

Belt buckles have been modified to include enlarged rigid compartments into which an item or items, such as a picture identification and credit card may be placed. This permits the person to not have to carry a wallet, which can be left behind in a more secure location such as at home or hidden in a locked automobile.

However, these prior-art types of belt buckles include a thick rigid compartment that makes the belt buckle thick and unappealing. This also alerts pickpockets of its presence.

Additionally, the prior art belt buckles with compartments either include an open top for the compartment that makes access to the picture identification and credit card (or whatever else may be carried therein) easy for a pickpocket to remove. It also creates a potential whereby gravity can cause these items to fall out of the belt buckle compartment and become lost when the person bends sufficiently far forward for any reason, such as to pick up something from the floor.

Other prior art types of belt buckles that include a compartment require either total or partial removal of the belt from the trousers in order to open the compartment. This is not practical, as it takes excessive time to accomplish and also because the person attempting to access the compartment may appear somewhat odd to those observing his (or her) actions. This can embarrass the user and deter use of such a product.

It is also important to note that the thickness of prior art belt buckles that include a compartment is constant, whether or not there are any credit cards or forms of identification in the compartment.

Prior art types of belt buckles are also large and heavy. They are large because the face of the buckle has to hide the compartment and therefore must be considerably larger than the size of the compartment. Prior art types of belt buckles are also heavy because the compartment is also made of the same material, typically a metal or metallic alloy, as is an exterior face plate of the prior art type of the belt buckle.

And additionally, it is not possible to change the face of any of these prior art types of belt buckles with a compartment attached thereto.

Also, prior art types of belt buckles with compartments tend to be linear, straight devices that provide a linear compartment. However, an ideal shape for a belt buckle is curved so that it matches the general anatomical shape of the wearer.

Additionally, a curved belt buckle is aesthetically more pleasing than is a straight type (i.e., one that is not curved) of a belt buckle.

Furthermore, for any given thickness of belt buckle, with or without a compartment, a straight (linear) belt buckle protrudes further out from a wearer's torso than does a curved belt buckle. This is unattractive and, if a compartment is included, makes the belt buckle stand out as being one of the type that includes a compartment attached thereto.

This provides easy visual recognition for a potential pickpocket alerting the pickpocket that the belt buckle is of the type that probably contains a credit card or valuable picture identification.

Also, prior art types of belt buckles that include a compartment are generally difficult and expensive to manufacture, and they rely upon unorthodox and sometimes difficult to use fastening mechanisms.

It is desirable to provide an especially thin belt buckle that can also house, at a minimum, a valid picture identification and a credit card.

Accordingly, there exists today a need for a belt buckle that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and are not specifically mentioned herein.

Clearly, such an apparatus would be a useful and desirable device.

2. Description of Prior Art

Belt buckles are, in general, known. For example, the following patents describe various types of these devices:

U.S. Pat. No. 3,969,836 to DuBois, that issued on Jul. 20, 1976;

U.S. Pat. No. 4,113,157 to Woodbury, that issued on Sep. 12, 1978;

U.S. Pat. No. 4,502,188 to Kohli, that issued on Mar. 5, 1985;

U.S. Pat. No. 5,357,638 to Mayzel, that issued on Oct. 25, 1994; and

U.S. Pat. No. 5,687,890 to Wanner, that issued on Nov. 18, 1997.

Also, a prior art belt buckle that includes a metal compartment at a rear inner surface of the buckle and which includes a front surface (i.e., a face) that resembles a flag with a skull and cross-bones image thereon is available for sale at the worldwide web at viciousstyle.com.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a belt buckle that includes a compartment attached thereto.

It is also an important object of the invention to provide a belt buckle that includes a compartment which is flexible.

Another object of the invention is to provide a belt buckle that includes a compartment which is thin.

Still another object of the invention is to provide a belt buckle that includes a compartment which includes a first thickness when nothing is disposed therein and a second greater thickness when a credit card or identification or both are disposed therein.

Still yet another object of the invention is to provide a belt buckle that includes a compartment that is curved.

Yet another important object of the invention is to provide a belt buckle that includes a face plate that is curved.

Still yet another important object of the invention is to provide a belt buckle that secures a belt around a torso in a conventional manner.

A first continuing object of the invention is to provide a belt buckle that can accommodate a variety of face plates.

A second continuing object of the invention is to provide a belt buckle that is easy to manufacture.

A third continuing object of the invention is to provide a belt buckle that is economical to manufacture.

A fourth continuing object of the invention is to provide a belt buckle that is easy to fasten and remove.

A fifth continuing object of the invention is to provide a belt buckle that can retain a credit card sized object during use and which permits easy withdrawal of the object when the object is needed.

A sixth continuing object of the invention is to provide a belt buckle that includes a compartment and wherein the appearance of a front of the belt buckle is unaffected by the compartment.

A seventh continuing object of the invention is to provide a belt buckle that includes a flexible member with a fastener assembly attached to the flexible member, and wherein the fastener assembly is adapted to secure a first end of a belt end and a second end of a belt, and wherein a force required to maintain the first end of the belt relative to the second end of the belt is experienced by the fastener assembly and not by the flexible member.

An eight continuing object of the invention is to provide a belt buckle that includes a container or compartment for storing a credit card or a picture-identification card or both therein and which allows removal or insertion of the cards in the container while the belt buckle is disposed around a torso and secured in position by a belt that is not unloosed.

Briefly, a belt buckle that is constructed in accordance with the principles of the present invention has a face plate. A flexible member is attached along a perimeter thereof on three sides of the flexible member to a rear surface of the face plate. A conventional type of a fastener assembly for a belt is attached to the flexible member. A first end of the belt is attached to a rear end of the fastener assembly and a second end of the belt engages with a hook, the hook being attached to an opposite front end of the fastener assembly. The face plate can be straight or curved. An opening between the face plate and the flexible member along a side of the flexible member that is not attached to the face plate is provided on the remaining side of the flexible member into which a credit card and a picture-identification card, such as a driver's license can be inserted or removed. The flexible member is preferably attached to the face plate by an adhesive or, alternately, by a hook and loop fastener. The fastener assembly is preferably attached to the flexible member by a pair of rivets that pass through the fastener assembly and through the flexible member.

DETAILED DESCRIPTION OF THE INVENTION

Figure 1:
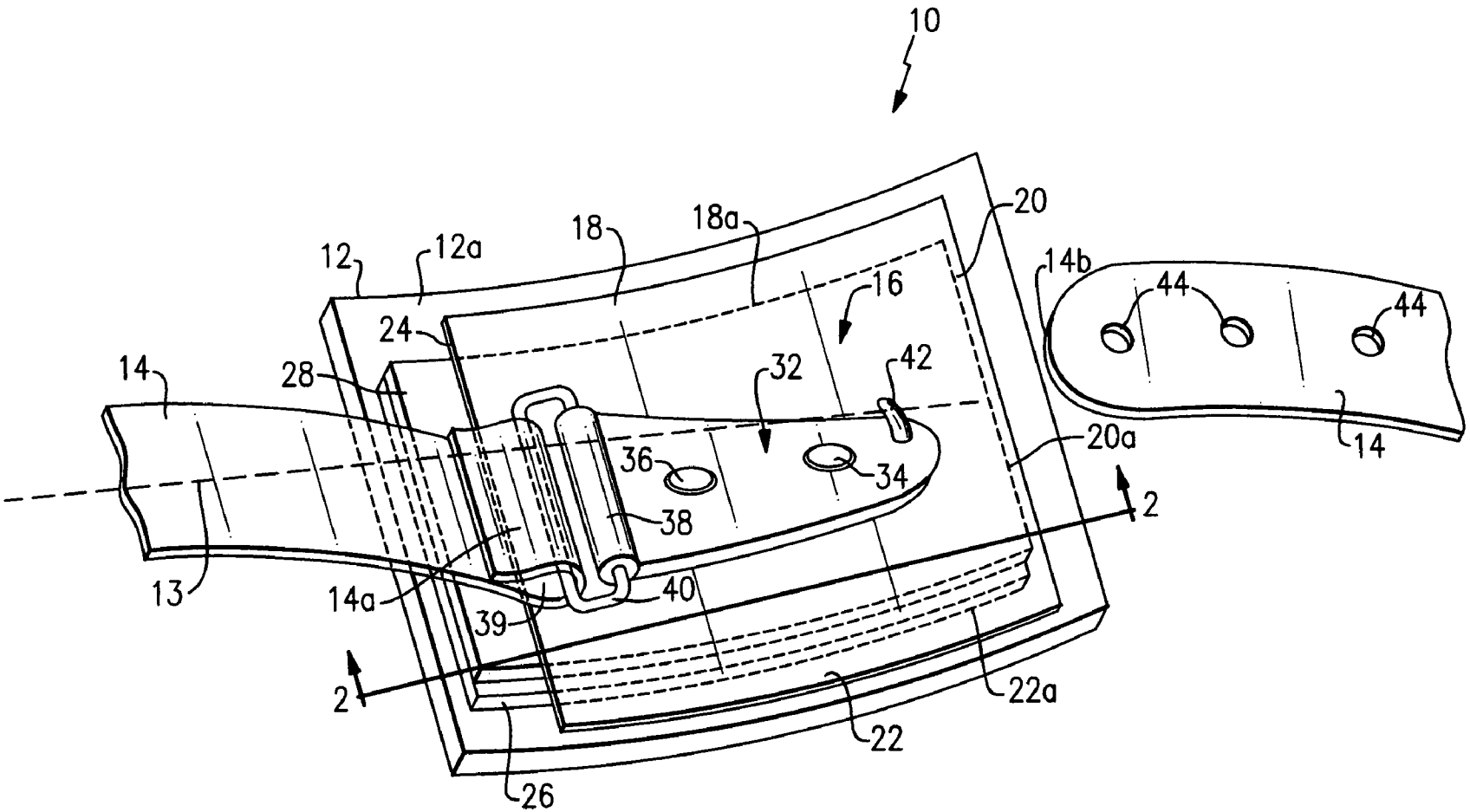
FIG. 1 is a view in perspective of a rear side of a belt buckle.
Figure 2:
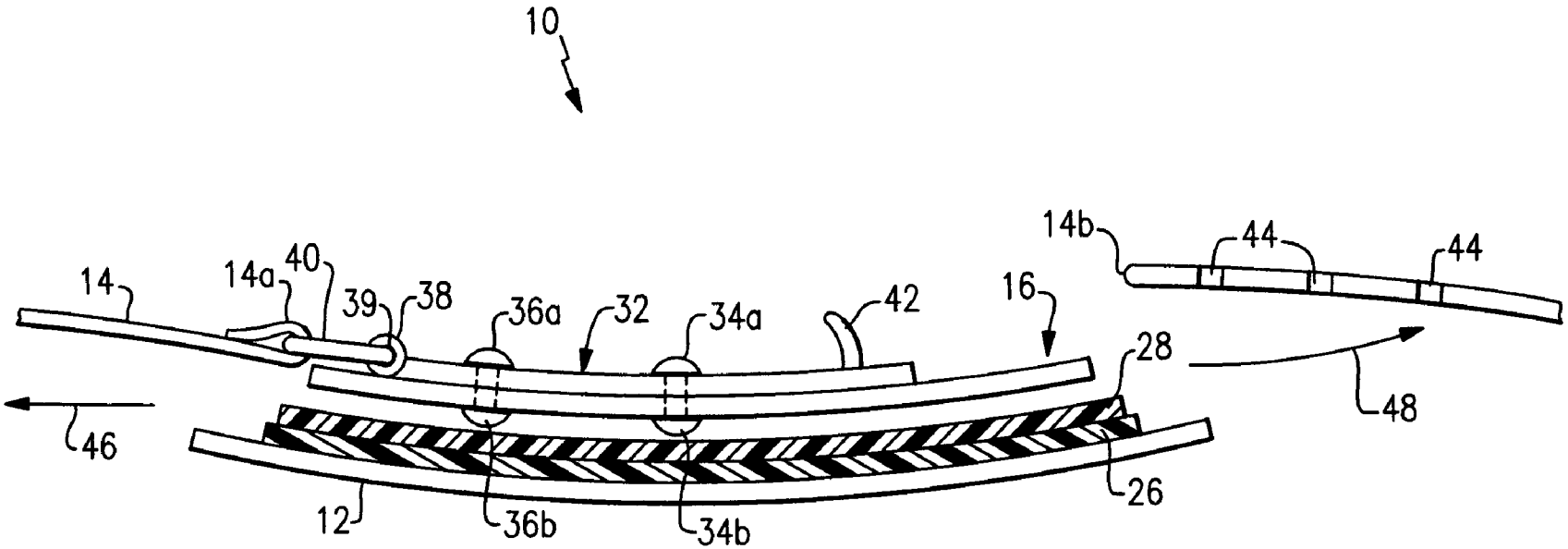
FIG. 2 is a slightly modified cross sectional view taken on the line 2-2 in FIG. 1, the modification being that a flexible member and fastener of FIG. 1 are disposed in FIG. 2 in a spaced-apart orientation away from a face plate, for improved clarity.

Referring to FIG. 1 and on occasion to FIG. 2 is shown, a belt buckle, identified in general by the reference numeral 10. A rear side of the belt buckle 10 that normally faces the abdomen of a user, is shown.

The belt buckle 10 includes a face plate 12. The face plate 12 includes any type of material and any size and shape as desired. It is preferred that the face plate 12 include a curvature that extends (i.e., curves) along a longitudinal length 13 (dashed line) thereof. The longitudinal length of the face plate 12 aligns with a longitudinal axis of a belt 14.

A curvature of the face plate 12 along the longitudinal length 13 thereof corresponds generally with a curvature of the human torso and is, therefore, more natural looking than would be a planar version of the face plate 12.

However, if a planar version of the face plate 12 is desired, it is equally well suited for use with the belt buckle 10. What is significant is that the belt buckle 10 can accommodate a curved face plate 12 and still provide storage capabilities, as are described in greater detail hereinafter.

A flexible member, identified in general by the reference numeral 16, is attached to a rear surface 12*a* of the face plate 12 by an adhesive along a perimeter at a top side 18, a rear side 20, and a bottom side 22, the area of the adhesive being contained from the perimeter edge of the flexible member 16 to each of the respective dashed lines 18*a*, 20*a*, 22*a*. The adhesive is disposed on a bottom surface of the flexible member 16.

Accordingly, the flexible member 16 is secured to the rear surface 12*a* (i.e., the surface closest to the torso when the belt buckle 10 is worn) of the face plate 12 along three sides (18, 20, 22) of the flexible member 16.

The flexible member 16 does not contain adhesive along the longitudinal length of a front side 24. Accordingly, the flexible member 16 provides a pouch-like container or compartment that is disposed between the rear surface 12*a* of the face plate 12 and a bottom surface of the flexible member 16. Access into the compartment is from the front side 24.

A preferred material for the flexible member 16 is leather, although other materials may be used. A reason for this, as will be described in greater detail hereinafter, is that during use, no strain by the tension of the belt 14 is exerted upon the flexible member 16.

Accordingly, the flexible member 16 does not have to withstand great forces during use, thereby allowing use of other flexible materials that are not as strong as is leather. However, leather is generally regarded as being aesthetically superior in appearance, feel, and quality to many other materials and is, therefore, generally preferred.

A longitudinal length of the flexible member 16 along the top side 18 or along bottom side 22 is preferably less than the maximum longitudinal length of a credit card 26 and a picture identification card 28. A common type of the picture identification card 28 is a driver's license.

The credit card 26 and the picture identification card 28, as shown, are both disposed between the bottom surface of the flexible member 16 and the rear surface 12*a* of the face plate 12. The credit card 26 is disposed adjacent to the rear surface 12*a* of the face plate 12 and the picture identification card 28 is disposed on top of the credit card 26. Both cards 26, 28 are fully inserted along the longitudinal length 13 as far as they each can readily be inserted toward the rear side 20. Of course, the relative positions of the credit card 26 and the picture identification card 28 can be reversed.

If desired, other types of similarly sized cards (not shown) can be used in place of either the credit card 26 or the picture identification card 28, or both. It may be possible, depending on how tightly the flexible member 16 is secured to the rear surface 12*a* of the face plate 12 to insert more than the two cards 26, 28 in the space between the flexible member 16 and rear surface 12*a* of the face plate 12. However, the ability to insert two cards 26, 28 is considered as an optimum minimum number.

Because the longitudinal length of the top side 18 or the bottom side 22 is less than the longitudinal length of either of the cards 26, 28, a small protruding portion of the cards 26, 28, identified in general by the reference numeral 30, protrudes out from the flexible member 16 and is disposed over the rear surface 12*a* of the face plate 12, which extends sufficiently far beyond the front side 24 of the flexible member 16 to ensure that the protruding portion 30 of the cards 26, 28 does not extend beyond the face plate 12.

During use one at a time, an end of the credit card 26 and the picture identification card 28 are aligned with the front side 24 of flexible member 16 and are urged under the flexible member 16 and over the rear surface 12*a* toward the rear side 20 as far as they will each readily go. As shown, the credit card 26 is first inserted followed by the picture identification card 28, which is placed atop the credit card 26 and under the flexible member 16.

Normally, the cards 26, 28 are inserted when it is most easy to do so, for example, before the belt buckle 10 and the belt 14 are disposed over the torso.

A conventional type of a fastener assembly, identified in general by the reference numeral 32, is attached to a top surface of the flexible member 16 by a first rivet 34 and by a second rivet 36. The first rivet 34 and the second rivet 36 each contain a rounded top 34*a*, 36*a* respectively (see FIG. 2) and a rounded bottom 34*b*, 36*b* respectively.

The rivets 34, 36 pass through openings provided in the fastener assembly 32 and corresponding adjacent openings provided in the flexible member 16, thereby securing the flexible member 16 (and therefore the face plate 12) to the fastener assembly 32.

The rounded tops 34*a*, 36*a* ensure that the rivets 34, 36 will not irritate the torso of a user (not shown). The rounded bottoms 34*b*, 36*b* ensure that insertion of the credit card 26 and of the picture identification card 28 will not be impeded by contact with the rivets 34, 36.

The fastener assembly 32 is a well known item that is normally attached directly to the face plate 12 of prior art types of belt buckles (not shown).

The fastener assembly 32 is generally made of metal of suitable strength. The fastener assembly 32 includes a hollow cylindrical end 38 that is disposed at a rear of the fastener assembly 32. A first end of a cylindrical metal loop 40 passes through an opening 39 that is provided through the cylindrical end 38.

The loop 40 is generally rectangular shaped and is able to pivot about an axis passing through the hollow cylindrical rear end 38. A first end 14*a* of the belt 14 passes around an opposite second end of the cylindrical metal loop 40. The first end 14*a* of the belt 14 is stitched to itself, thereby securing it to the second end of the loop 40.

Accordingly, the loop 40 and the hollow cylindrical end 38, which are attached to the fastener assembly 32, together, provide a means for securing the first end 14*a* of the belt 14 to the fastener assembly 32.

An inwardly curved hook 42 is attached to the fastener assembly 32 at a front thereof. The front of the fastener assembly 32 is opposite with respect to the rear of the fastener assembly 32, where the cylindrical end 38 and the loop 40 are disposed. The hook 42 is either molded or welded or otherwise attached to the fastener assembly 32.

The belt 14 has a continuous longitudinal length that extends from the first end 14*a* to an opposite distally disposed second end 14*b*. A plurality of holes 44 are disposed at spaced-apart intervals proximate the second end 14*b*.

During use, the belt buckle 10 is disposed and maintained in the front and center area of the torso of the user while the second end 14*b* of the belt 14 is progressively threaded around the torso, through each successive belt loop (not shown) of a pair of pants or trousers (not shown).

After the belt 14 has been wrapped around the torso the second end 14*b* is pulled toward the first end 14*a* to tighten the belt 14 around the torso. During tightening, the second end 14*b* may be pulled beyond the first end 14*a*, as needed, until the belt 14 is tight and one of the holes 44 is disposed generally over a top of the hook 42.

At this time the hole 44 that is nearest the hook 42 is urged toward and then over the hook 42, thereby securing the second end 14*b* of the belt 14 relative to the first end 14*a* of the belt 14. This maintains the belt buckle 10 at the front and center on the torso, thereby giving a pleasing appearance. It also secures the trousers or pants (or shorts) in position about the torso of the user. To remove the belt buckle 10 the procedure is reversed.

Accordingly, the hook 42 that is attached to the fastener assembly 32 and which cooperates with a desired one of the holes 44 of the belt 14, provide a means for detachably-attaching the second end 14*b* of the belt 14 to the fastener assembly 32.

It is especially important to note that as the belt 14 is tightened and secured at both ends thereof to the fastener assembly 32, the fastener assembly 32 is placed under tension. The tension is attempting to pull apart the fastener assembly 32 as force at the first end 14*a* of the belt 14 is applied to the fastener assembly 32 in the direction of arrow 46 and force at the second end 14*b* of the belt 14 is applied to the fastener assembly 32 in the direction of arrow 48.

All of the tension is experienced only by the fastener assembly 32. None of the tension is experienced by the flexible member 16 or by the face plate 12. This extends the useful life of the flexible member 16 and, therefore, the useful life of the belt buckle 10.

The credit card 26 and the picture identification card 28 naturally curve in response to the curvature of the face plate 12 during insertion. If the face plate 12 is planar (i.e., not curved), then the credit card 26 and the picture identification card 28 remain in a non-curved planar orientation when inserted into the belt buckle 10.

This design provides a very thin overall thickness to the belt buckle 10 which is desirable for aesthetic reasons. The belt buckle 10, with the credit card 26 and the picture identification card 28 attached thereto, is virtually indistinguishable apart from other prior art types of belt buckles (not shown) that do not provide any type of container for securing the credit card 26 and the picture identification card 28.

Accordingly, a pickpocket would not even suspect that the credit card 26 and the picture identification card 28 are disposed under the face plate 12 and therefore would not be inclined to attempt to steal them.

If for some reason a pickpocket were to attempt to steal the credit card 26 or the picture identification card 28, the pickpocket would have to dispose a portion of his or her hand between the tightly secured belt 14 and the torso of the wearer. This is almost certain to be felt by the user, thereby deterring such effort. Accordingly, the belt buckle 10 provides substantial deterrence to theft of the credit card 26 or the picture identification card 28.

It is important to note that the belt buckle 10 securely retains the credit card 26 and the picture identification card 28 in position regardless of the attitude taken by the wearer. This prevents accidental loss of the credit card 26 or the picture identification card 28.

Another advantage is provided by the belt buckle 10 in that the user, while the belt 14 is fastened around the torso, can still readily remove the credit card 26 or the picture identification card 28 or both for use, as needed.

The user merely contracts their stomach muscles while pushing the first end 14*a* of the belt 14 toward their torso. This, thereby, creates room for the user to place a finger on the protruding portion 30 of the uppermost one of the cards 26, 28 and urge whichever card (either the credit card 26 or the picture identification card 28) in a direction away from the rear side 20. The credit card 26 or the picture identification card 28 is urged out of the belt buckle 10 and over the second end 14*b* of the belt 14 while the second end 14*b* of the belt 14 is still attached to the fastener assembly 32.

The credit card 26 or the picture identification card 28 can be inserted into the belt buckle 10 while the belt 14 is secured around the torso by contracting the stomach muscles and reversing the procedure used for removal. If preferred, the belt 14 can be loosened and the second end 14*b* of the belt 14 removed from the belt buckle 10 prior to a reinsertion of the credit card 26 or the picture identification card 28, or both, into the belt buckle 10.

It is possible to attach the flexible member 16 to the face plate 12 by means other than by use of the adhesive, for example, by use of a hook and loop fastener as is sold under the tradename VELCRO. This would allow removal of the face plate 12 when desired apart from a remainder of the belt buckle 10 and quick attachment of another face plate (not shown) thereto. In this manner, the appearance of the belt buckle 10 can be readily changed to accommodate any type of clothing that is worn or to better correspond with the occasion.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A belt buckle for use in fastening a belt, comprising:

(a) a face plate that includes a front surface that is visible when said belt buckle is worn and an opposite rear surface;

(b) a flexible member attached on three perimeter sides thereof to said rear surface of said face plate and wherein said flexible member is not attached to said rear surface of said face plate on a fourth perimeter side of said flexible member; and (c) a fastener assembly attached to said flexible member, said fastener assembly including means for securing a first end of the belt to said fastener assembly and including second means for detachably-attaching a second end of the belt to said fastener assembly.

2. The belt buckle of claim 1 wherein said face plate is planar.

3. The belt buckle of claim 1 wherein said face plate includes a curvature along a longitudinal length thereof.

4. The belt buckle of claim 1 wherein said three perimeter sides include a top side, a rear side, and a bottom side and wherein said top side, said rear side, and said bottom side are attached to said rear surface of said face plate by an adhesive.

5. The belt buckle of claim 1 wherein a space disposed between said top side, said rear side, and said bottom side of said flexible member and said rear surface of said face plate provides a compartment.

6. The belt buckle of claim 5 wherein said compartment includes a shape and a size sufficient to retain more than half of a credit card shaped object therein.

7. The belt buckle of claim 5 wherein said compartment is adapted to receive at least one object therein, and wherein said object is the size of a credit card, and wherein when said object is inserted in said compartment, a small protruding portion of said object extends out from said compartment.

8. The belt buckle of claim 1 wherein said flexible member is formed of leather.

9. The belt buckle of claim 1 wherein said means for securing said first end of the belt to said fastener assembly includes a hollow cylindrical end that is disposed at a rear of said fastener assembly and a cylindrical metal loop that is pivotally attached to said hollow cylindrical end, and wherein said first end of the belt is attached to said loop, and wherein said second means for detachably-attaching said second end of the belt to said fastener assembly includes a hook that is attached to an opposite front end of said fastener assembly, and wherein said hook cooperates with one of a plurality of holes that are disposed proximate to said second end of the belt to detachably-attach said second end of the belt to said fastener assembly.

10. The belt buckle of claim 1 wherein said fastener assembly is attached to said flexible member by at least one rivet that passes through an opening provided in said fastener assembly and through an adjacent opening provided in said flexible member.

11. The belt buckle of claim 1 wherein said means for securing a first end of the belt to said fastener assembly includes a hollow cylindrical end that is disposed at a rear of the fastener assembly and a cylindrical metal loop that is pivotally attached at a first end of said loop to said hollow cylindrical end, and wherein said first end of the belt is attached to a second end of said loop.

12. The belt buckle of claim 1 wherein said second means for detachably-attaching said second end of the belt to said fastener assembly includes a hook that is attached to a front end of the fastener assembly and wherein said hook cooperates with one of a plurality of holes that are disposed proximate to said second end of the belt to detachably-attach said second end of the belt to said fastener assembly.

13. A belt buckle for use in fastening a belt, comprising:

(a) a face plate that includes a front surface that is visible when said belt buckle is worn and an opposite rear surface;

(b) a flexible member attached on three perimeter sides thereof to said rear surface of said face plate, and wherein said three perimeter sides include a top side, a rear side, and a bottom side and wherein said top side, said rear side, and said bottom side are attached to said rear surface of said face plate by an adhesive, and wherein said flexible member is not attached to said rear surface of said face plate on a fourth perimeter side of said flexible member, and wherein a space disposed between said top side, said rear side, and said bottom side of said flexible member and said rear surface of said face plate provides a compartment and wherein said compartment is adapted to receive at least one object therein, and wherein said object includes a size that is generally the same as that of a credit card, and wherein when said object is inserted in said compartment, a small protruding portion of said object extends out from said compartment; and (c) a fastener assembly attached to said flexible member, and wherein said fastener assembly includes a hollow cylindrical end that is disposed at a rear of said fastener assembly and a cylindrical metal loop that is pivotally attached to said hollow cylindrical end, and wherein a first end of the belt is attached to said loop, and wherein said fastener assembly includes a hook that is attached to an opposite front end of said fastener assembly and wherein said hook cooperates with one of a plurality of holes that are disposed proximate to a second end of the belt to detachably-attach said second end of the belt to said fastener assembly.

* * * * *